US005497978A

United States Patent [19]

Yamashiro et al.

[11] Patent Number: 5,497,978

[45] Date of Patent: Mar. 12, 1996

[54] APPARATUS FOR CHARGING SCRAP INTO A CONVERTING FURNACE

[75] Inventors: Akiyoshi Yamashiro; Kiyoshi Fujiwara; Nobuhiro Oguma, all of Kagawa, Japan

[73] Assignee: Mitsubishi Materials Corporation, Tokyo, Japan

[21] Appl. No.: 229,540

[22] Filed: Apr. 19, 1994

[51] Int. Cl.[6] ..... C21B 7/16

[52] U.S. Cl. ..... 266/176; 266/216; 266/901

[58] Field of Search ..... 266/176, 216, 266/901; 25/581, 650, 651, 652

[56] References Cited

U.S. PATENT DOCUMENTS 4,264,060 4/1981 Twyman ..... 266/901

4,691,900 9/1987 Maeda ..... 266/901

*Primary Examiner*—Scott Kastler

*Attorney, Agent, or Firm*—Ronald J. Kubovcik

[57] ABSTRACT

An apparatus for charging anode scrap into a converting furnace in a continuous copper smelting line without impairing the heat balance of the furnace. Anode scrap is moved into the opening of a chute by means of a charging mechanism. An outer shutter of the furnace is opened and an inner shutter is closed. After closing the outer shutter the inner shutter is opened and anode scrap is charged into the converting furnace. The operation is continuously repeated as the anode scrap is continuously conveyed into the converting furnace. The temperature of the furnace is maintained substantially constant since it is not exposed to ambient air temperature.

7 Claims, 4 Drawing Sheets

Fig.5
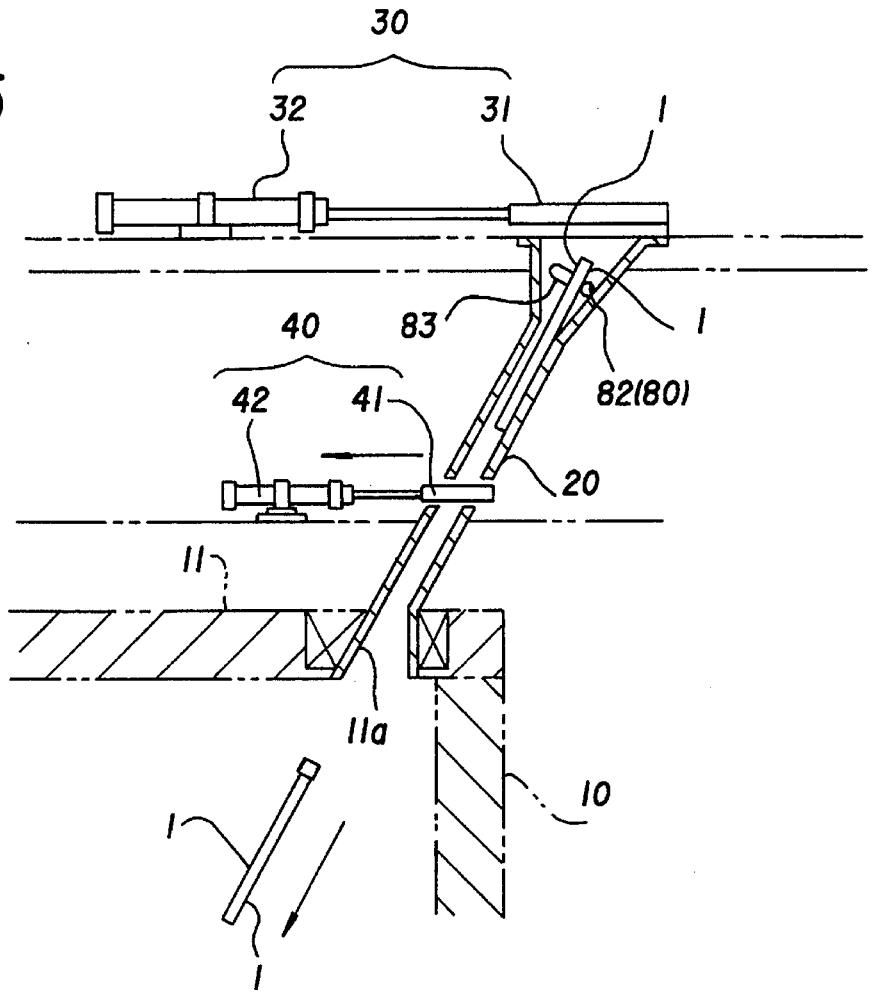
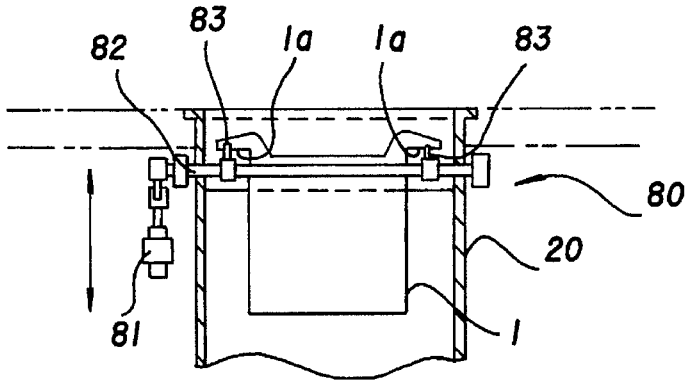
Fig.6

APPARATUS FOR CHARGING SCRAP INTO A CONVERTING FURNACE

FIELD OF THE INVENTION

The present invention relates to an apparatus for charging scrap into a converting furnace and, particularly, to an apparatus for charging anode scrap into a converting furnace used for continuous smelting of copper sulfide ore.

DESCRIPTION OF THE PRIOR ART

In a process for continuous smelting of copper sulfide ore, an apparatus for carrying out the process and comprising a smelting furnace, a separating furnace, and a converting furnace contiguously connected together via launders (known as the MI process) has conventionally been known. The process comprises the steps of first melting copper concentrate in the smelting furnace to produce matte mainly containing copper sulfide and iron sulfide, and slag mainly consisting of gangue contained in the raw material, flux and iron oxides, then, separating matte from slag in the separating furnace. Subsequently, blister copper is produced through oxidation of matte in the converting furnace. The thus obtained blister copper (melt) is directed into an anode furnace where the grade of copper is improved through oxidation and reduction reactions. The melt is then cast into an anode for electrorefining to obtain the finished product.

In the electrorefining step, although the anode wears away during the progress of refining, the entire mass of the anode is not fully utilized, but flakes of anode scrap remain as residue. It is, therefore, a common practice to charge the residual anode scrap again into the smelting furnace or the separating furnace for reuse of the anode scrap.

However, because anode scrap is high-grade copper available through the anode furnace, it is not desirable from the point of view of energy efficiency to again charge anode scrap into the smelting furnace or the separating furnace. There has, therefore, been a demand for reusing anode scrap by charging it into a converting furnace.

A converting furnace, however, produces blister copper by oxidizing molten copper, and the heat balance is rather closely controlled for the purpose of properly controlling the reactions. When charging anode scrap into the converting furnace, opening and closing of the charging port causes leakage of furnace heat to the outside, thus exerting an adverse effect on the heat balance. Achievement of successful recharging of anode scrap has thus been difficult because of this problem.

SUMMARY OF THE INVENTION

The present invention was developed to overcome the problems described above, and has as an object to provide an apparatus for charging anode scrap, which permits anode scrap to be charged into a converting furnace without disturbing the heat balance in the furnace.

The apparatus for charging anode scrap according to the present invention comprises an opening, provided in the ceiling or the side wall of a converting furnace, for communicating the interior of the converting furnace with the outside; an outer shutter and an inner shutter, spaced apart from each other in and outside the converting furnace, for opening and closing the opening independently from each other; and a charging mechanism for charging anode scrap through the opening. While the description in the present specification is based on an embodiment with the use of an MI-process converting furnace, it is needless to mention that the apparatus of the present invention is also applicable also to other types of furnaces such as a flash furnace.

First, in the state in which the outer shutter is opened and the inner shutter is closed, anode scrap is charged through the opening by means of the charging mechanism. Then, after closing the outer shutter, the inner shutter is opened, and anode scrap is charged into the converting furnace. Subsequently, the inner shutter is closed and the outer shutter is opened to charge the next batch of anode scrap through the opening. The same cycle is repeated thereafter and anode scrap can thus sequentially be charged into the converting furnace.

BRIEF DESCRIPTION OF THE DRAWINGS

FIG. 5 is a descriptive view illustrating anode scrap as charged into the chute in FIG. 4; and FIG. 6 is a partial sectional view taken along the line D—D in FIG. 4.

DETAILED DESCRIPTION OF THE PREFERRED EMBODIMENTS

The apparatus of charging anode scrap according to an embodiment of the present invention will be described below with reference to FIGS. 1 to 6.

Figure 4:
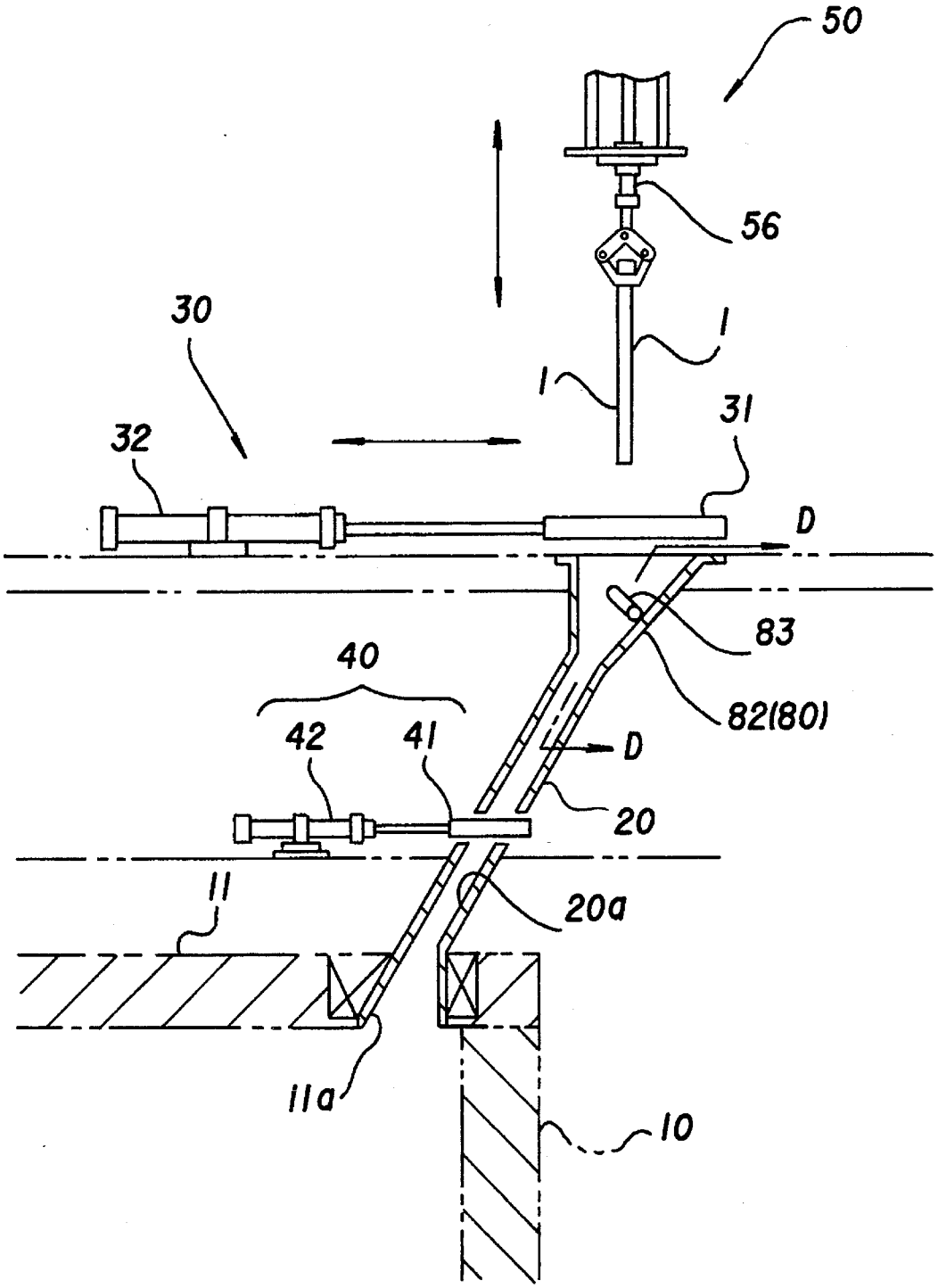
FIG. 4 is a partially enlarged sectional view taken along the line C—C in FIG. 1.

This apparatus for charging includes a through-hole 11*a*, provided in the ceiling 11 of a converting furnace 10 in a continuous smelting line of copper sulfide ore, for communicating the interior of the converting furnace 10 with the exterior (see FIG. 4). A chute 20, which may be substantially rectangular, is secured onto the inner surface of the through-hole 11*a*. An outer shutter 30 and an inner shutter 40 are spaced apart from each other and opened and closed independently of each other. A charging mechanism 50 is provided for transporting anode scrap 1 to a position above the opening end of the chute 20 and charging it into the chute 20. A transfer mechanism 60 is provided for transferring anode scrap 1 to this charging mechanism 50. In the apparatus of this embodiment, the interior of the chute 20 forms an opening 20*a* for communicating the interior of the converting furnace 10 with the outside. Anode scrap to be handled by the apparatus is formed into substantially rectangular sheets each having projections formed on both shoulders thereof, and the lower sides of these projections serve as engagements 1*a* for facilitating transfer.

The construction of the transfer mechanism 60 will first be described below with reference to FIG. 1. This transfer mechanism 60 comprises a rack 61 for temporarily storing the transferred anode scrap sheets 1; a stock conveyor 62, provided adjacent the rack 61, for transferring the anode scrap sheets 1 in a vertical posture to a first transfer mechanism 66 (described later); a bogie 63, provided so as to be self-travellable on rails (not shown) installed above the stock conveyor 62 and rack 61, which holds the anode scrap sheets 1 placed on the rack 61 in the vertical position with an arm 63*a* and puts it on the stock conveyor 62. Four electrically driven jacks (not shown) vertically move the arm 63*a* of the bogie 63. A first lifter 64 is installed below the terminal end of the stock conveyor 62 for lifting the anode scrap sheets 1 transferred by the stock conveyor 62 one by one by expansion and contraction of a hydraulic cylinder. Rails 65 extend from above the first lifter 64 to above the lower end of an inclined conveyor 68 (described later). A first transfer mechanism 66, provided so as to be self-travellable on the rails 65, receives the anode scrap sheets 1 from the first lifter 64 and transfers them to a second lifter 67 (described later); the second lifter 67 receives the anode scrap sheets 1 from the first transfer mechanism 66 and lowers the sheets, via an air cylinder, to a starting end (lower end) of an inclined conveyor 68, provided adjacent the second lifter 67, engages the anode scrap sheets 1 brought down by the second lifter 67 and transfers them diagonally upward. A fast-feed conveyor 69, provided contiguously with the terminal end (upper end) of the inclined conveyor 68, transfers the anode scrap sheets 1 at a speed about twice as high as the transfer speed of the inclined conveyor 68. A lift-arm bogie 72 travels forward and backward by the action of an electrically driven ball-screw mechanism 71 on rails 70 installed below the terminal end of the fast-feed conveyor 69. A lift arm 73, is provided on the front face (right side surface in FIG. 1) of a lift-arm bogie 72, which receives the anode scrap sheets 1 at the terminal end of the fast-feed conveyor 69 and lifts up the anode scrap sheets 1 by expansion of an air cylinder at the time it receives two anode scrap sheets 1, and delivers them to the charging mechanism 50.

The first transfer mechanism 66 discussed above comprises a bogie 66*a* with its wheels on the rails 65; two lifting cylinders 66*b* fixed to the lower surface of the bogie 66*a;* and chucks 66*c*, fitted to the rods of the lifting cylinders 66*b* for holding and releasing the anode scrap sheets 1.

Figure 1:
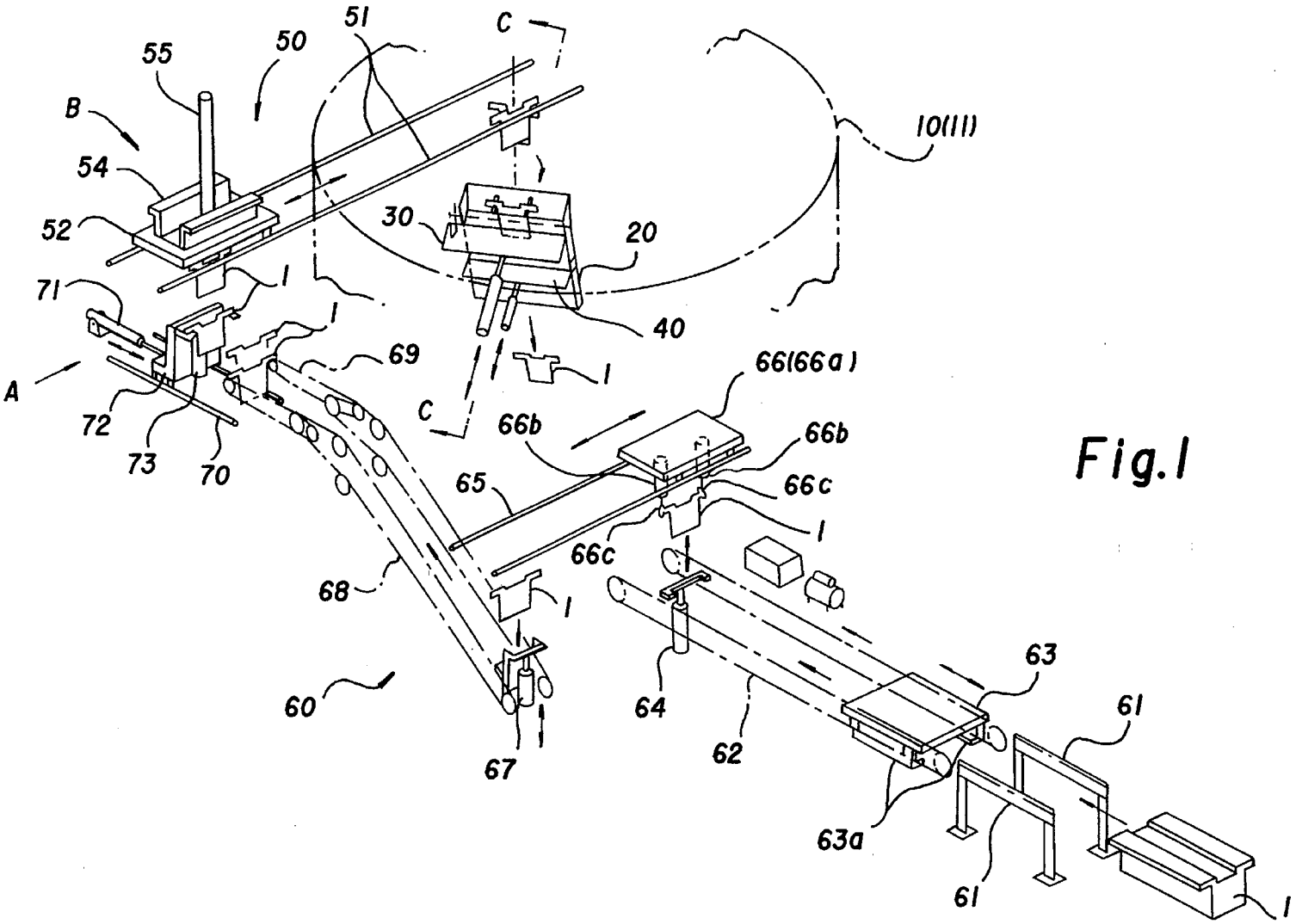
FIG. 1 is a schematic view of an embodiment of the present invention illustrating an apparatus for charging anode scrap.
Figure 2:
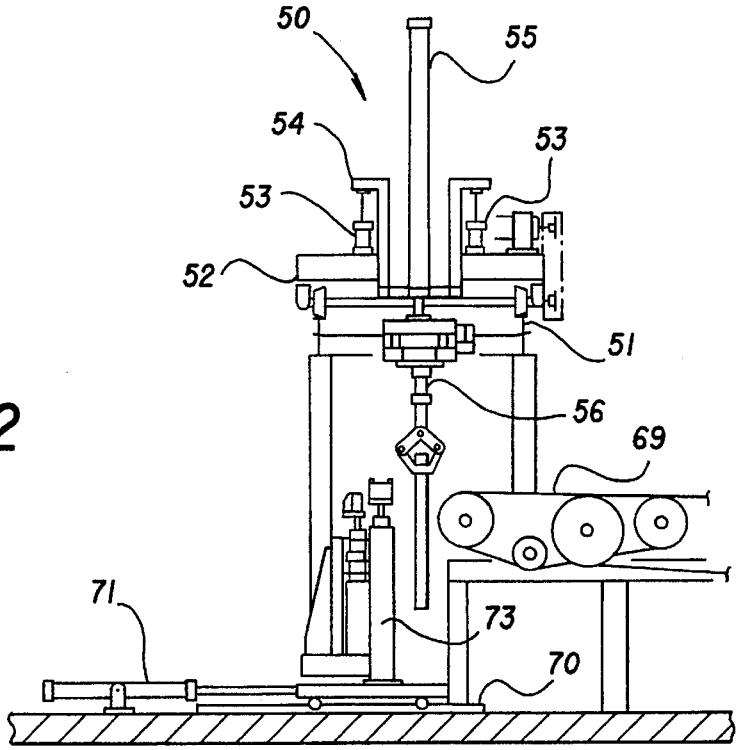
FIG. 2 is a partially enlarged view of FIG. 1 as viewed in the direction of arrow A.
Figure 3:
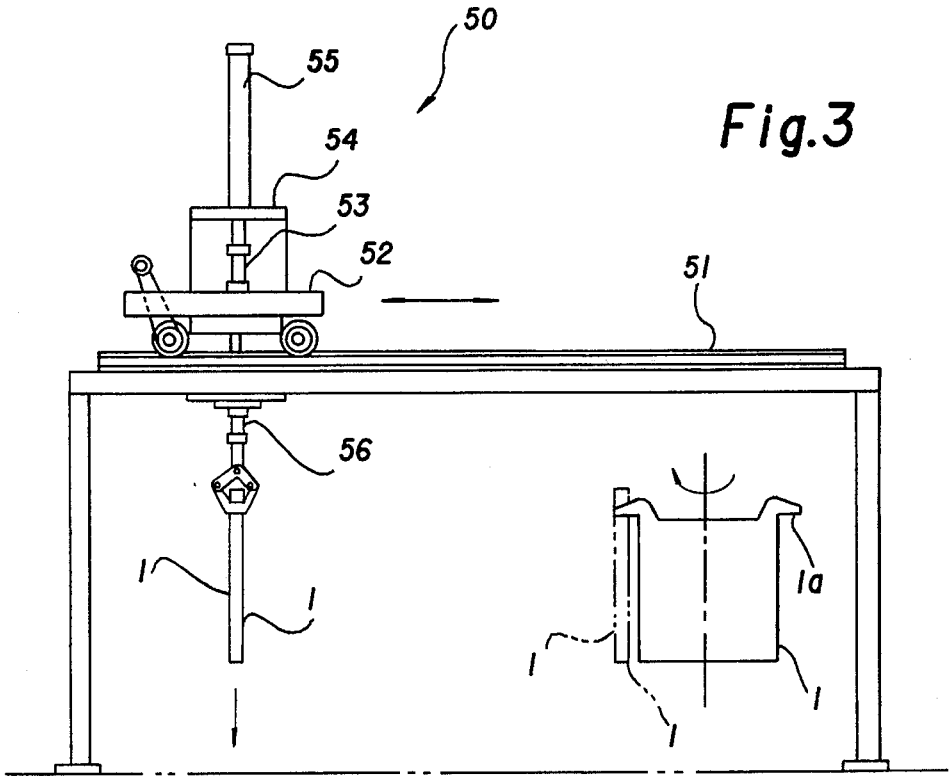
FIG. 3 is a partially enlarged view of FIG. 1 as viewed in the direction of arrow B.

The above-mentioned charging mechanism 50 comprises rails 51 extending from above the setback position, defined as the position at which the ball-screw mechanism 71 sets back to the left side in FIG. 1, of the lift-arm bogie 72 to above the chute 20 (see FIGS. 1 to 3); a bogie 52 having wheels which engage the rails 51 so as to be self-travellable; and, two first lifting cylinders 53 provided vertically on the upper surface of the bogie 52 as shown in FIG. 2. The cylinders 53 are provided with rods on the upper side. A substantially U-shaped sliding plate 54 is secured to the rods of the first lifting cylinders 53 and slidably engaged relative to the bogie 52. A second lifting cylinder 55 is secured to the sliding plate 54 with the rod directed downward, so that the rod is movable in the axial direction relative to the sliding plate 54. A chuck 56 is rotatably fitted to the lower end of the rod of the lifting cylinder 55 around the rod axis and holds the anode scrap sheets 1, and a rotation mechanism (not shown) rotates the chuck 56 through an angle of about 56° around the axis. The rotating mechanism comprises an air cylinder and a link mechanism.

The outer shutter 30 comprises, as shown in FIG. 4, a plate-shaped shutter body 31 substantially closing the upper end of the chute 20; and an air cylinder 32 controlling horizontal travel of the shutter body 31.

Similarly, the inner shutter 40 comprises a shutter body 41 substantially closing the middle portion between the upper and lower ends of the chute 20. An air cylinder 42 drives the shutter body 41 for controlling horizontal movement in a manner like that of body 31.

As shown in detail in FIGS. 4 to 6, a receiving mechanism 80 provides temporary stoppage of the anode scrap sheets 1 charged into the chute 20 and is positioned in the chute 20, between the shutter body 31 and the shutter body 41. This receiving mechanism 80 comprises a rotation shaft 82 which passes through the chute 20 in the width direction and is rotated through an angle of about 80° by a link by expansion and contraction of cylinder 81. Two substantially parallel barshaped projections 83 are fixed to the rotation shaft 82 and spaced apart from each other by a gap slightly smaller than the gap of the engagements 1*a* formed at the shoulder portions of each anode scrap sheet 1. The projections engage with the engagements 1*a* of the anode scrap sheet 1 charged into the chute 20.

The operation of the charging apparatus of the embodiment having the configuration as presented above will be described.

First, a batch of about 50 anode scrap sheets is placed by means of a fork lift truck or other suitable device onto the rack 61 of the transfer mechanism 60. Then, the bogie 63 is moved on the rack 61, and the engagements la of the anode scrap sheet 1 are held by the arm 63*a* by raising an electrically driven jack fitted to the arm 63*a*. The bogie 63 is then moved onto the stock conveyor 62, and the anode scrap sheets 1 are placed on the stock conveyor 62 by lowering the electrically driven jack. Then, the anode scrap sheets 1 are positioned, by the stock conveyor 62, above the first lifter 64. The first lifter 64 is extended to cause the leading end thereof to engage with engagements la of one anode scrape sheet 1 so as to lift the anode scrap sheet 1. The anode scrap sheet is held by the chuck 66*c* of the first transfer mechanism 66, and the first lifter 64 returns to its initial position thereof.

After the lifting cylinder 66*b* of the first transfer mechanism 66 contracts and causes the anode scrap sheet 1 to go up, the bogie 66*a* travels on the rails 65 to transfer the anode scrap sheet 1 to a position above the second lifter 67. The lifting cylinder 66*b* thus expands to lower the anode scrap sheet 1, and at the same time, the second lifter 67 expands and the leading end thereof supports the anode scrap sheet 1, releasing the chuck 66*c*. Subsequently, the second lifter 67 contracts, and the anode scrap sheet 1 is lowered to engage with the inclined conveyor 68. The inclined conveyor 68 lifts the engaged anode scrap sheets and delivers them one by one to the fast-feed conveyor 69. The fast-feed conveyor 69, at its terminal end, places the anode scrap sheets 1 one by one on the upper end of the lift arm 73. When two of the anode scrap sheets 1 are placed on the upper end of the lift arm 73 as a result of these operations, the lift arm 73 extends to slightly raise the two anode scrap sheets and, in this state, the ball-screw mechanism 71 contracts, so that the lift-arm bogie 72 moves to a position below the bogie 52 of the charging mechanism 50. Contraction of the first lifting cylinder 53 lowers the sliding plate 54, whereby the second lifting cylinder 55 and the chuck 56 move downwardly, the anode scrap sheets 1 being held by the chuck 56. After delivering the anode scrap sheets 1 to the charging mechanism 50, interference between the anode scrap sheets 1 and the lift arm 73 is prevented by contraction of the lift arm. Then, after the bogie 52 moves to a position above the chute 20, the ball-screw mechanism 71 is driven to bring the lift-arm bogie 72 back to its starting position.

In the charging mechanism 50, after holding the anode scrap sheets 1 with the chuck 56, the first lifting cylinder 53 extends to raise the anode scrap sheet 1, and the bogie 52 travels on the rails 51 to position the anode scrap sheets 1 above the chute 20. While the bogie 52 travels on the rails 51, the chuck 56 is caused to rotate by about 56° around the axis by the rotation mechanism connected to the chuck 56.

The surfaces of the anode scrap sheets 1 are kept parallel with the width direction of the chute 20.

After positioning the bogie 52 above the chute 20, the air cylinder 32 of the outer shutter 30 contracts so that the linkage connected to the shutter body 31 opens the upper end portion of the chute 20. Then, after contraction of the first lifting cylinder 53 and descent of the anode scrap sheets 1 resulting from the extension of the second lifting cylinder 55, the chuck 56 releases the scrap sheet so as to charge the scrap sheets 1 into the chute 20. The engagements 1*a* formed on the both shoulders of each of the anode scrap sheets 1 engage with the projections 83 provided on the receiving mechanism 80 (see Figs. 5 and 6), and stop the sheets in the chute 20. Collision of the lower end of the anode scrap sheet 1 with the inner shutter 40 and resulting damage to the inner shutter 40 can thus be prevented.

After the air cylinder 32 extends and the shutter body 31 closes the upper end of the chute 20, the air cylinder 42 of the inner shutter 40 contracts, so that the shutter body 41 is moved back from the interior of the chute 20. Then, the rotation shaft 82 of the receiving mechanism 80 rotates, thus causing the projections 83 to rotate counter-clockwise by about 80° . Engagement between the projections 83 and the anode scrap sheet 1 is thus released and the anode scrap sheet 1 falls. The anode scrap sheets 1 can thus be charged through the chute 20 into the converting furnace 10.

The air cylinder 42 is then extended so as to cause the shutter body 41 to close the chute 20, and at the same time, rotation of the rotation shaft 82 in the opposite direction (clockwise in FIG. 5) causes the projections 83 to return to the initial position.

By repeating the operations described above, it is possible to charge the anode scrap sheets sequentially into the converting furnace.

In the charging apparatus of this embodiment, the anode scrap sheet 1 is charged into the chute 20 when the chute 20 is closed by the inner shutter 40, and the anode scrap sheet 1 is charged into the converting furnace by opening the inner shutter 40 when the opening end of the chute 20 is closed by the outer shutter 30. The interior of the converting furnace therefore never communicates with ambient air, and heat dissipation to the outside of the furnace can be inhibited to an almost negligible extent. Therefore, the heat balance in the furnace is almost free from disturbance during charging of anode scrap sheets into the furnace, thus preventing adverse effects on the smelting operations. More specifically, according to the apparatus of this embodiment, it is possible to reuse anode scrap comprising high-grade copper by charging anode scrap into the converting furnace 10 and hence to improve energy efficiency.

In the apparatus of this embodiment, the chute 20 is provided in the through-hole 11*a* of the converting furnace 10, and the shutters 40 and 30 are provided in and outside, respectively, of the chute 20. The chute 20 is not an essential component of the apparatus of the present invention. Shutters 30 and 40 may be directly attached, for example, to the through-hole 11*a* of the ceiling 11 for charging anode scrap. In this variation, the through-hole 11a serves as the opening provided in the ceiling.

In the embodiment presented above, the opening is provided in the ceiling 11, through which anode scrap is to be charged. It is, however, possible to provide an opening in the side wall of the converting furnace 10, through which anode scrap is to be charged. In this case, it is needless to mention that the opening should be provided at a position higher than the molten copper level.

The present examples and embodiments are to be considered as illustrative and not restrictive, and the invention is not to be limited to the details set forth herein, but may be modified within the scope of the appended claims.

What is claimed is:

1. An apparatus for charging scrap into a converting furnace, comprising:

an outer shutter;

a chute having an open first end adjacent to said outer shutter and an open second end extending into an opening provided in the furnace;

an inner shutter positioned between said open first end and said open second end, said outer shutter operable for movement between a first position exposing said open first end and a second position closing said open first end and, said inner shutter operable for movement between a first position exposing said open second end and a second position closing said open second end, said first and said second shutter independently operable of each other; and, a charging means for charging said scrap into said open first end of said chute.

2. An apparatus for charging scrap into a converting furnace as set forth in claim 1, comprising:

said open second end of said chute extending into a through-hole provided in a wall of said converting furnace;

receiving means positioned interiorally of said chute for temporary stoppage of said scrap in said chute, said receiving means positioned between said first and said second shutter; and transfer means for transferring said scrap to said charging mechanism.

3. An apparatus for charging scrap into a converting furnace as set forth in claim 2, in which said receiving means further comprises:

a rotatable shaft extending through a side wall of said chute;

an expandable and contractible piston-cylinder connected to said shaft; and a plurality of projections fixed to said shaft to be rotatable therewith, said projections engaging said scrap charged into said chute.

4. An apparatus for charging scrap into a converting furnace as set forth in claim 3, wherein said shaft is rotatable through an arc of approximately 80°.

5. An apparatus for charging scrap into a converting furnace as set forth in claim 3, wherein said scrap is provided with shoulder portions engageable with said projections.

6. An apparatus for charging scrap into a converting furnace as set forth in claim 1, wherein said first shutter and said second shutter directly contact said chute when said open first end and said open second end are closed.

7. An apparatus for charging anode scrap into a converting furnace as claimed in claim 2, wherein an opening is provided in a side wall of the converting furnace, said anode scrap being charged through said side wall.

* * * * *